United States Patent [19]

McDaniel et al.

[11] 4,070,940

[45] Jan. 31, 1978

[54] MACHINE TOOL WITH PROTECTIVE LIGHT CURTAIN AND WORK STOCK HOLDING MECHANISM

[75] Inventors: John H. McDaniel; Harry W. Sinnard, both of Decatur; Robert W. Thomas, Blue Mound, all of Ill.

[73] Assignee: Caterpillar Tractor Co., Peoria, Ill.

[21] Appl. No.: 764,666

[22] Filed: Feb. 1, 1977

[51] Int. Cl.[2] ..... B26D 7/02; B26D 7/24

[52] U.S. Cl. ..... 83/464; 83/DIG. 1; 83/58; 192/130

[58] Field of Search ..... 83/DIG. 1, 58, 59, 464; 192/130, 129 A, 129 R, 134

[56] References Cited

U.S. PATENT DOCUMENTS

| | | | |
|---|---|---|---|
| 1,958,128 | 5/1934 | Cate | 192/130 |
| 2,058,668 | 10/1936 | Davis | 192/130 |
| 2,241,556 | 5/1941 | Mac Millin et al. | 192/130 |
| 2,963,627 | 12/1960 | Buchsbaum | 192/130 |

*Primary Examiner*—Donald R. Schran
*Attorney, Agent, or Firm*—Phillips, Moore, Weissenberger, Lempio & Majestic

[57] ABSTRACT

A shear machine having a blade for cutting successive increments of material from flat sheet work stock has a cutting zone guarded by a curtain of light. Photosensitive means actuates a brake to stop blade motion if an object extends through the light curtain towards the cutting zone. Hold-down mechanism is operated by a lever or the like situated outside of the guarded region to enable the final portion of a sheet of work stock to be manually held in place at the cutting zone without penetrating the light curtain. The plane of the light curtain inclines towards the front of the shear machine enabling the hold-down mechanism control lever or the like to be situated on the machine above the cutting zone where it may be reached without interception of the light curtain by the operator.

14 Claims, 6 Drawing Figures

MACHINE TOOL WITH PROTECTIVE LIGHT CURTAIN AND WORK STOCK HOLDING MECHANISM

BACKGROUND OF THE INVENTION

This invention relates to systems for safe-guarding operators of machine tools and more particularly to systems of this type which establish a radiant energy screen in front of a cutting zone or the like to detect the presence of some portion of the operator's body in the immediate vicinity of the cutting zone.

A variety of protective mechanisms have heretofore been utilized to safeguard the operators of large powered machine tools which have a work zone at which cutting operations, work stock deformation or the like takes place. In some instances the protective mechanisms simply create a physical barrier around the work zone at critical stages of machine tool operation. Another type of protective machanism does not impose any actual barrier between the operator and the work zone but acts instead to detect the presence of any sizable object, such as the operator's hand, for example, in the vicinity of the work zone. In many cases, these detector mechanisms react to detection of such an object by stopping operation of the machine tool.

In one highly advantageous system of this kind radiant energy such as infrared light is directed across a planar area situated between the work zone of the machine and the operator's station to establish what is termed a light curtain. Photoelectric sensor means variously sound an alarm or stop operation of the tool if the light curtain is penetrated by an object as large or larger than the operator's fingers.

In some usages of a light curtain system, work stock being processed at the machine tool must be positioned and held in place by the operator during at least certain stages of the work cycle. This does not pose serious problems in situations where the work stock is sufficiently lengthy to extend outside of the region protected by the light curtain. Under those conditions, the work stock may be gripped by the operator without triggering the protective mechanisms. In such cases, either a thin space is present below the light curtain to allow for extension of the work stock toward the work zone or the sensitivity of the photoelectric sensor means is adjusted so that it is not triggered by a thin sheet of work stock but does react to thicker objects such as an operator's hand.

The light-curtain type of protective mechanism has not heretofore been suited to a situation where work stock which must be held by an operator is too short to extend outside of the protected region. Moreover, an essentially similar problem can occur under circumstances where the work stock is initially large enough to be gripped at a location outside of the protected region. For example, large powered shear machines are often used in manufacturing plants to cut small pieces out of flat sheet work stock. As a series of such cuts are made the operator pushes the end of the flat sheet material progressively closer to the light curtain. If the light curtain were to be situated extremely close to the cutting zone, the desired protective function may not be fully realized as a finite period of time is required to stop cutting blade movement. On the other hand, if it is distant from the work zone under the condition described above then eventually a stage is reached where the operator can no longer hold the end portion of the work stock without penetrating the light curtain with his hands. Under these circumstances it has heretofore been necessary to discard the terminal portion of the work stock although there may be sufficient material left to form one or more of the desired cut pieces. In a high-volume manufacturing operation, this can be a very significant source of material wastage.

SUMMARY OF THE INVENTION

The present invention is directed to overcoming one or more of the problems as set forth above.

According to the present invention work operations are made possible at a machine tool protected by a light curtain under circumstances where the work stock must be held in place but is too short to be gripped by the operator without penetrating the light curtain and thereby stopping operation of the machine tool.

Hold-down means are provided between the light curtain and the cutting zone or the like for selectively clamping work stock in place by manipulating a lever or the like which is itself situated outside the region protected by the light curtain. Consequently an operator may extend his hands into the protected region to position work stock while the machine tool is inactive and may then later continue to hold the work stock in place indirectly as a cutting operation or the like is initiated.

In one highly advantageous form, the invention is utilized at a shear machine which has a table for receiving flat sheet work stock and which has a cutting blade that is driven downward at a cutting zone to shear successive increments from the sheet of material. A transverse light curtain is present above the table a substantial distance outwardly from the cutting blade and actuates a brake to stop motion of the blade if the light curtain is penetrated by an object such as the operator's fingers. The hold-down means may include a clamping member extending across the front of the shear machine within the region protected by the light curtain. One or more levers or the like are situated outside the protected region and are coupled to the clamping member through linkage which does not penetrate the light curtain but enables raising and lowering of the clamping member relative to the work-receiving table in order to hold work stock in place at the cutting zone.

The plane of the light curtain is preferably inclined with the upper part being closer to the front of the shear machine than the lower part. This situates the lower part of the protected region well outward from the cutting zone while enabling the operator to grasp a hold-down control lever or the like, situated above the cutting zone, without penetrating the light curtain.

DESCRIPTION OF A PREFERRED EMBODIMENT

Figure 1:
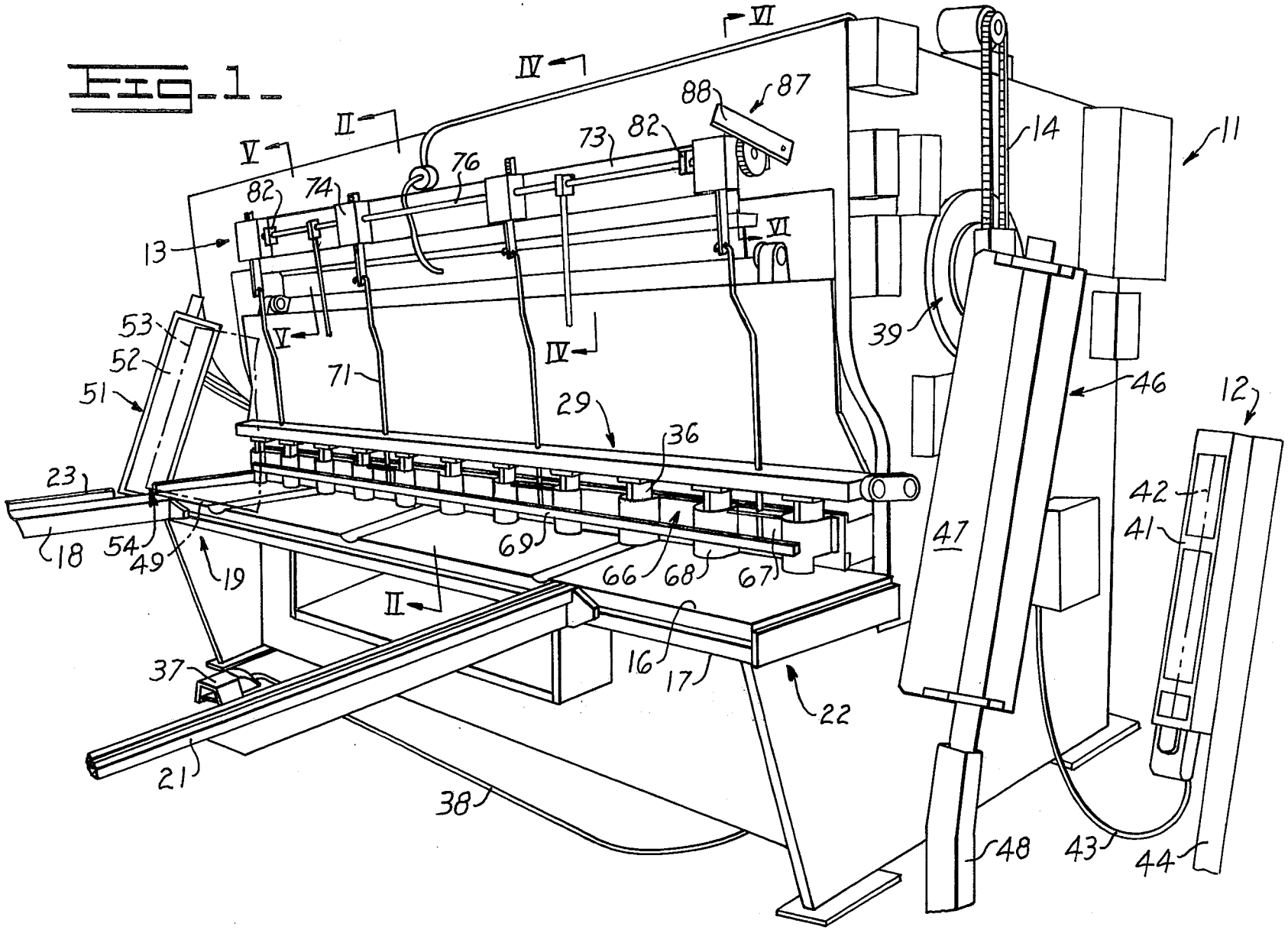
FIG. 1 is a perspective view of a shear machine equipped with a light curtain and work stock hold-down in accordance with the invention.
Figure 2:
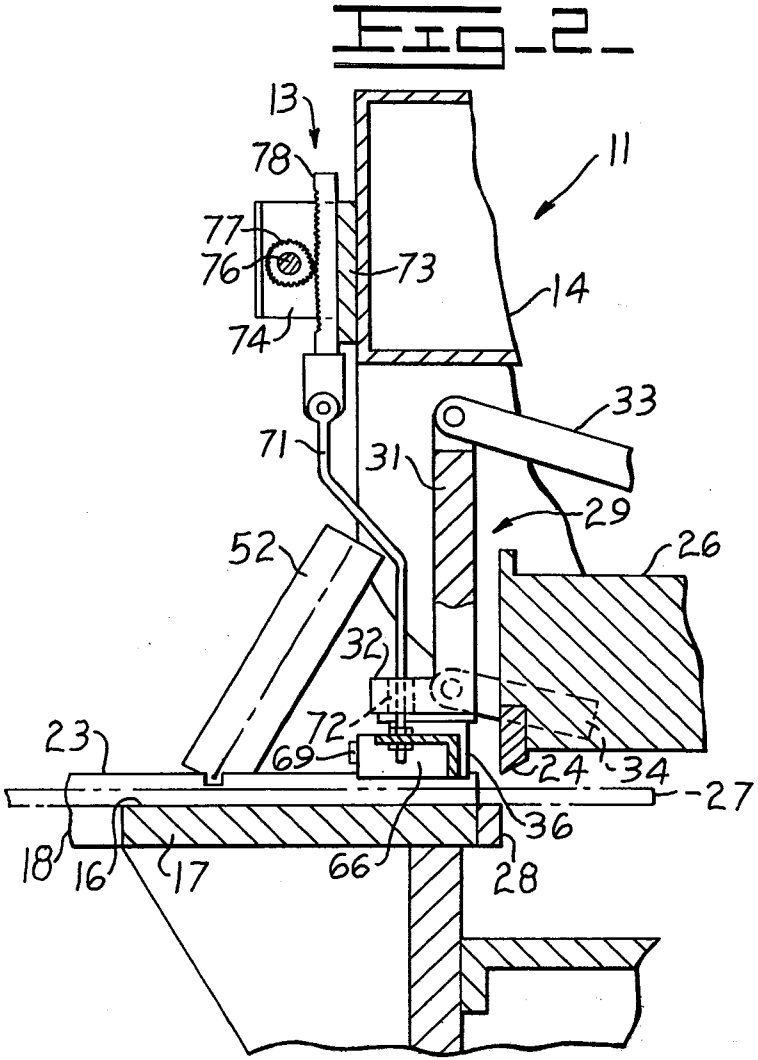
FIG. 2 is a partial cross-section view of the apparatus of FIG. 1 taken along line II—II thereof.

Referring initially to FIGS. 1 and 2 of the drawing in conjunction, there is shown a form of powered machine tool known as a shear machine 11 which may be essentially of the known construction except insofar as it is provided with a light curtain means 12 for establishing a protective radiant energy screen in front of the work zone at which shearing takes place and except insofar as it is further provided with an operator-actuated auxiliary work stock hold-down means 13, both of which will hereinafter be described in more detail. Although the shear machine 11 may otherwise be of conventional construction, certain salient elements of the machine with which the present invention directly coacts will be briefly described to facilitate an understanding of the invention.

The shear machine has a frame 14 and a work stock-receiving guide surface 16 is defined by a horizontal table 17 which extends outward from the front surface of the frame. To aid in guiding and supporting flat rectangular sheets of work stock, a first rail 18 extends outward from table 17 at one side 19 of the shear machine and a second rail 21 extends outward near the other side 22 of the shear machine, the spacing of rail 21 from rail 18 being determined by the width of the work stock. To aid in the positioning of the work stock as it is fed into the shear machine, rail 18 is of angled cross section in order to have a vertically extending side guide edge 23.

As best seen in FIG. 2 in particular, the tool element which performs the machining operation in a shear machine 11 of this kind is a cutting blade 24 mounted on a pivot arm 26 which may be moved downwardly to enable the blade to shear off successive increments of the flat rectangular sheet work stock 27. To aid the shearing action of cutting blade 24, a stationary cutting element 28 is secured along the inner edge of table 17 adjacent the path of travel of the cutting edge of blade 24.

The work stock 27 should be firmly held in position on surface 16 as the blade 24 descends to perform a cutting operation. For this purpose shear machines 11 are conventionally provided with an internal hold-down means 29. In this example the internal hold-down consists of an upright rectangular member 31 having a shelf 32 at the lever end which extends a small distance outward above table surface 16 and in parallel relation to the table and which is supported by upper and lower pivot arms 32 and 33 respectively. Hold-down member 31 is driven downwardly in advance of the cutting blade at the beginning of a cutting operation and is then lifted a small distance at the conclusion of the work cycle to enable advancement of another portion of the work stock to the cutting zone. To clamp the work stock 27 in place when member 31 descends, a series of spaced-apart parallel clamping elements 34 extend downwards toward surface 16 from the underside of shelf 32.

Referring now to FIG. 1 in particular, the operator is normally stationed at the front of the shear machine between rails 18 and 21. A foot-operated switch 37, connected to the shear machine through a flexible cable 38 is situated on the floor at that location so that the operator may initiate cutting operations while also holding the portion of the work stock which is remote from the cutting zone of the machine. Operation of foot switch 37 actuates a blade and hold-down drive system 39 as will hereinafter be discussed in more detail.

For safety reasons it is highly desirable that a shear machine 11 of this form be equipped with an operator's protection system which either creates a physical barrier between the operator's station and the work zone at which cutting of the work stock occurs or, alternately, acts to stop operation of the shear machine if an object other than the work stock is extending into the region near the work zone. This function is performed in the present invention by the light curtain means 12 which acts to stop operation of the shear machine if a foreign object other than the work stock extends into the region of the cutting zone from the front of the machine.

A light curtain system of this general type may include a source-sensor unit 41 which emits radiant energy along a linear light-emission zone 42 and which also detects such radiant energy if it is returned to the same zone. Light curtain systems of this kind produce an output voltage on an output conductor 43 provided that a predetermined proportion of the emitted energy is returned back to zone 42. The voltage drops in response to a predetermined degree of decrease of the returned energy thereby signaling that an object is penetrating the light curtain. While radiant energy of any of a variety of wavelengths may be utilized to establish the protective light curtain, it is usually preferable to use energy within the infrared range as it is not visible to the operator and also because it is not affected by changes in ambient external visible light illumination in the region of the shear machine.

Suitable internal constuctions for an infrared source-sensor unit 41 of this form are known to the art and accordingly will not be described herein, one device of this kind adaptable for the present purposes being the Model-8100 SAFE-T-LIGHT (TM) manufactured by the Weldotron Corporation of 1532 South Washington Avenue, Piscataway, N.J. 08854, United States of America.

The source-sensor unit 41 is secured to a support post 44 at side 22 of the shear machine rearwardly from table 17 to direct infrared light in a forward and upwardly inclined direction to a first reflector means 46. The first reflector means 46 may be a rectangular infrared reflecting mirror 47 secured to another support post 48 and positioned to receive the light emitted from source-sensor unit 41 and to reflect the light through a ninety degree angle into a planar area 49 extending across the front of the machine above table 17. A second reflector means 51 is situated at the opposite side 19 of the shear machine at planar area 49 to return the light back to mirror 47. The second reflector means 51 may also be a rectangular infrared reflecting mirror 52 and is positioned normal to the light curtain area 49 so that intercepted light is redirected back across the front of the shear machine within the same plane 49 and then returned to linear zone 42 of the source-sensor unit 41 by the first mirror 47. Thus the rectangular planar area 49 extending transversely across the front of the shear machine together with the path along which light travels between source-sensor unit 41 and first mirror 47 defines a protective light curtain between the operator and the cutting zone of the shear machine and penetration of the curtain by any object of significant size such as the operator's fingers or the like is signaled by a voltage drop on the output conductor 43. The light curtain can be extended along the opposite side 19 of the shear machine by the use of additional mirrors. That is not done in this example as access to the cutting zone from that side is blocked by adjacent structures in this particular installation.

Considering now the position and orientation of the reflector means 46 and 51 in greater detail, it has heretofore been the practice to establish light curtains of this form in a strictly vertical plane extending transversely across the front of a machine tool at a location very close to the cutting zone or the like so that the operator may grip short work pieces without penetrating the light curtain and stopping the machine. For greater safety, the present invention provides for disposition of the light curtain plane 49 a substantial distance outward from the cutting zone while retaining the ability to process short work pieces which do not extend as far out as the position of the light curtain.

This is accomplished in part by inclining the first and second mirrors 47 and 52 towards the upper front portion of the shear machine. More specifically, the linear zones 53 along the mirrors at which light is received and reflected each have a lower end situated in the vicinity of the outermost edge of table surface 16 but at a level which is higher by an amount just sufficient to accommodate travel of the work stock along the surface 16 below the light curtain. In order to locate the lower edge of the light curtain area 49 at this level, a notch 54 is cut into the upwardly extending edge 23 of rail 18. The upper ends of mirrors 47 and 52 are closer to the front of the shear machine than the lower portions of the mirrors and thus the light curtain area 49 inclines toward the front of the shear machine. Provided that the source sensor unit 41 and mirrors 47 and 51 are of sufficient vertical length, the operator cannot extend his hands to the vicinity of the work zone without in the process penetrating the light curtain and generating an electrical signal on cable 43.

Figure 3:
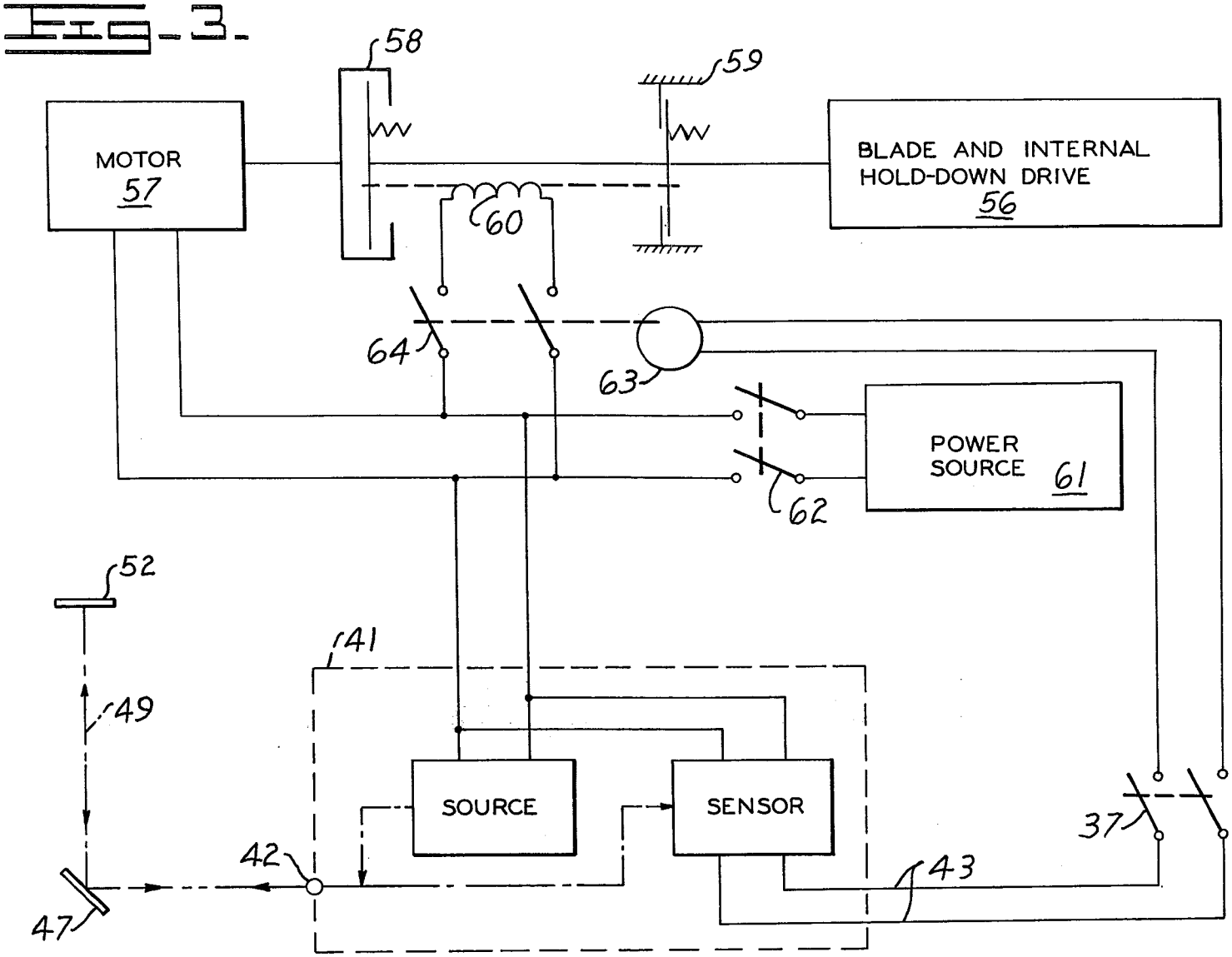
FIG. 3 is a circuit diagram illustrating suitable electrical connections between the light curtain components of the apparatus of FIG. 1 and pre-existing shear machine controls and mechanisms.

Referring now to FIG. 3, the blade drive mechanism 56 of a shear machine is typically driven by an electrical motor 57 through a rotary drive which includes a clutch 58 spring-biased to a normally disengaged condition and also a brake 59 which is spring-biased to a normally engaged position. The motor 57 is connected to an electrical power source 61 through a main control switch 62 which is closed to start the motor and to thereby ready the shear machine for operation. Closing of the main control switch 62 actuates the drive motor 57 and energizes the source-sensor unit 41 of the light curtain system but does not in itself initiate a cutting operation. As clutch 58 is normally disengaged while brake 59 is normally engaged, the motor 57 is decoupled from the blade drive mechanism 56 at that time and the blade drive mechanism is immobilized by the brake. Clutch 58 and brake 59 have a solenoid controlled actuator 60 which must be electrically energized, to engage the clutch and disengage the brake, in order for a cutting operation to begin and proceed.

A cutting operation is initiated by closure of the operator's foot switch 37 which is connected between the previously described output signal conductors 43 of source-sensor unit 41 and a relay driver coil 62. Upon being energized, driver coil 63 closes a set of normally open relay contacts 64 which are connected between clutch and brake actuator 60 and power source 61 through main control switch 62. Accordingly, brake 39 disengages and clutch 58 engages to initiate a cutting operation in response to the closure of the foot switch 37 but in order for a cutting operation to be initiated in this manner, the light curtain area 49 must be unpenetrated by any object. If some object is penetrating the light curtain 49 at the time foot switch 37 is closed, no output voltage is present on the output signal conductor 43 and driver coil 63 then remains unenergized. Consequently, clutch and brake actuator 60 also remains unenergized and no cutting operation begins until such time as the object is removed from the light curtain area. Should an object first penetrate through the light curtain area 49 while a cutting operation is already in progress, the output signal voltage disappears from conductor 43. Relay contacts 64 then open, clutch 58 disengages and brake 59 engages to stop operation of the blade drive mechanism.

Referring again to FIG. 1, the above-describedlight curtain means 12 protects the operator by preventing or stopping cutting operations at any time that some portion of the operator's body may be in the vicinity of the work zone or cutting zone, that is, inside the region defined by the planar light curtain area 49, table surface 16 and the front face of the shear machine.

Work stock must be securely held in position on surface 16 of the work-receiving table during a cutting operation. As previously described, shear machines 11 customarily come equipped with an internal hold-down means 29 which descends at the beginning stage of a cutting operation to clamp the work stock in position. During the period following initiation of a cutting operation but prior to the time that this clamping action of the internal hold-down means 29 has occurred, it is necessary that the operator manually retain the work stock in position. While this can readily be accomplished with work stock sufficiently long to extend outside the region protected by the light curtain, it is not possible for the operator to grasp directly a shorter piece of work stock without penetrating the light curtain and thereby stopping operation of the shear machine. To resolve this problem, the manually operated auxiliary hold-down means 13 is provided on the shear machine. Auxiliary hold-down means 13 enables cutting operations on short pieces of work stock including the terminal portions of work stock that may have initially been long enough to extend outside of the protected region.

Referring now to FIGS. 1 and 2 in conjunction, the auxiliary hold-down means 13 includes a clamping member 66 extending transversely above table 17 and below shelf 32 of the internal hold-down means 29. Clamping member 66 in this example has a convoluted configuration with rectangular sections 67, extending between adjacent pairs of the elements 36 of the internal hold-down means, being alternated with arcuate sections 68 which extend around the front of each such element 36. Owing to this configuration the clamping member 66 is able to perform a clamping action closer to the cutting blade 24 in the same region that clamping is later performed by the internal hold-down elements 36. A linear brace 69 extends along the front of the clamping member 66 and is welded to each arcuate section 68 of the clamping member to add rigidity to the structure.

To enable the operator to selectively raise and lower the clamping member 66 without penetrating the light curtain, a series of links 71 have lower ends secured to the clamping member 66 and extend upward through slots 72 in shelf 32 to a level above the light curtain area 49. A hold-down system mounting base 73 is secured to the front of the shear machine and extends transversely above the region protected by the light curtain. One of a series of gear housings 74 is secured to base 73 above the upper end of each link 71 and a linear rotatable rod 76 extends through each gear housing and across the front of the shear machine in parallel relationship to base 73.

Within each gear housing 74, a pinion gear 77 is disposed coaxially on rod 76 for rotation with the rod and engages a linear toothed rack 78 which extends vertically through the housing and which is translatable in a vertical direction by rotational motion of the associated gear 77. The upper end of each link 71 is coupled to the lower end of an associated one of the racks 78 so that rotational movement of rod 76 in one direction acts to lift the clamping member 76 while rotational movement of the rod in the opposite direction forcibly lowers the clamping member 66.

Figure 4:
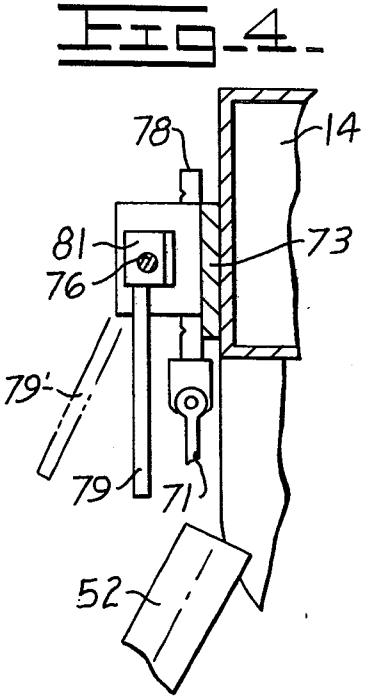
FIG. 4 is a partial cross-section view taken along line IV—IV of FIG. 1 and depicting an operator's control lever for operating the hold-down mechanism.

Referring now to FIG. 4 in conjunction with FIG. 1, a pair of spaced-apart levers 79 are secured to rod 76 by coupling devices 81 to enable the operator to rotate the rod in order to apply clamping force to work stock when desired without in the process penetrating his hands through the region protected by the light curtain. A pair of such control levers 79 are provided in this example since the operator may at different times be stationed at different transverse positions in front of the shear machine depending on the width of the work stock which is being cut at that time. Levers 79 are angularly oriented relative to rod 76 to extend downwardly when the clamping member is in the elevated position so that clamping force may be applied to work stock by pulling the levers outward and upward to the position indicated at 79' in FIG. 4. This orientation of the levers 79 reduces the risk of inadvertent penetration of the light curtain while the operator is manually applying clamping force.

Figure 5:
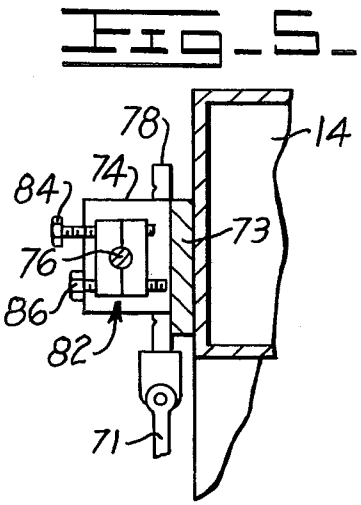
FIG. 5 is a partial cross-section view taken along line V—V of FIG. 1 illustrating hold-down mechanism motion-limiting means.

Referring now to FIG. 5 in conjunction with FIG. 1, a motion-limiting device 82 is disposed at each end of rod 76 to establish predetermined upper and lower limits for the vertical movement of the clamping member 66. Each motion-limiting device 82 in this example consists of a rectangular block 83 through which the rod 76 extends and which is secured to the rod for rotational motion therewith. A pair of adjustable bolts 84 and 86 threadably engage in the block and extend toward base 73 with bolt 84 being above rod 76 and bolt 86 being below the rod. Limits of rotational motion of the rod 76 are established by abutment of the ends of bolts 84 and 86 against base 73 as the rod is turned.

Figure 6:
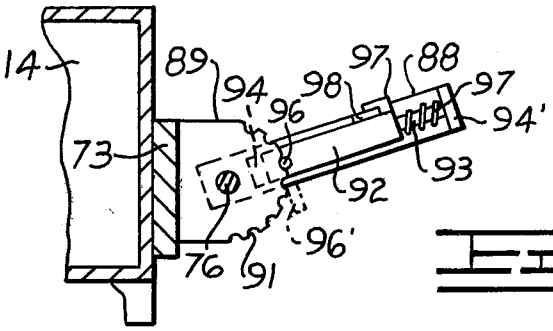
FIG. 6 is a partial cross-section view taken along line VI—VI of FIG. 1 illustrating a hold-down latching mechanism.

The mode of operation of the manually operated auxiliary hold-down means 13 as described above requires that the operator lift one of the levers 79 and hold it in a raised position throughout the period that a piece of work stock is to be manually clamped at the work zone. Under some circumstances the operator may need to maintain the hold-down means in a fixed position without having to continue grasping the lever. Referring now to FIG. 6 in conjunction with FIG. 1, a releasable latch means 87 is disposed at one end of rod 76 for this purpose. The latching means 87 in this example includes a pivotable latching lever 88 secured to the rod and extending outward from the rod adjacent a bracket 89 which is secured to base 73 and which has an arcuate outer surface provided with a series of notches 91 which are situated on an arc having a center of curvature coincident with the axis of rod 76. A tubular latch sleeve member 92 is slidable longitudinally along a rod 93 which extends along the side of lever 88 and which is supported on the lever by brackets 94 and 94'. Sleeve 92 carries a sidewardly projecting pin 96 which may be engaged in a selected one of the notches 91 by movement of the sleeve 92 towards rod 76. A spring 97 on rod 93 urges the sleeve 92 towards rod 76 so that the pin 96 may be held seated in a selected one of the notches 91 to lock the rod 76 in a selected angular orientation. Rotation of sleeve 92 is prevented, when pin 96 is seated in a notch 91, by a tang 97 which enters a slot in another bracket 98 on lever 88. Sleeve 92 may be retracted and rotated ninety degrees, to bring pin 96 to the position indicated at 96', when the releasable latch means is not being used.

Although the invention has been herein described with reference to usage at a shear machine, it is also applicable to other forms of power machine tool having a cutting zone, deformation zone or other work zone at which machine operation should be stopped if the operator's hands are in the vicinity of the work zone but at which it may be necessary to manually hold work pieces in that vicinity at least at times.

Thus while the invention has been described with respect to a specific embodiment, it will be apparent that many modifications are possible and it is not intended to limit the invention except as defined in the following claims.

The embodiments of the invention in which an exclusive property or privilege is claimed are defined as follows:

1. In combination with a machine tool of the type having guide means with a surface for receiving work stock and having a tool element which is selectively movable to perform a machine operation on said work stock at a predetermined work zone and further having an electrically controlled device for stopping motion of said tool element, mechanism for protecting and assisting an operator stationed in front of said machine tool comprising:

a radiant energy source positioned to direct radiant energy across a planar area extending between said work zone and said operator's station, a radiant energy sensor positioned to intercept radiant energy which has traveled across said planar area and having means for producing a signal indicative of a decrease of intensity of the intercepted radiant energy, means transmitting said signal to said electrically controlled device to stop motion of said tool element in response to said decrease of intensity of intercepted radiant energy, and manually operable auxiliary hold-down means for clamping said work stock against said guide means surface, said auxiliary hold-down having an actuating element situated outside the region between said planar area and said work zone.

2. The apparatus of claim 1 further comprising an operator's control switch for selectively initiating movement of said tool element, said control switch being situated outside said region between said planar area and said work zone, and means for inactivating said radiant energy sensor except when said control switch is actuated.

3. The apparatus of claim 1 wherein said planar area across which said radiant energy is directed by said source is inclined with an upper boundary of said planar area being closer to the front of said machine tool than a lower boundary of said planar area.

4. The apparatus of claim 3 wherein said work stock-receiving surface of said guide means is substantially coplanar with said work area and wherein said lower boundary of said planar area is spaced above said surface a distance sufficient to enable said work stock to be advanced toward said work zone without intercepting said planar area.

5. The apparatus of claim 3 wherein said radiant energy source has a linear energy-emitting zone and is disposed at one side of said machine tool to emit said radiant energy in an upwardly inclined direction toward the adjacent side of said planar area and further comprising first reflector means at said adjacent side of said machine tool, said first reflector means being inclined and angled to receive radiant energy from said source and to redirect said received radiant energy into said inclined planar area.

6. The apparatus of claim 5 wherein said radiant energy sensor is combined with said source and has photosensitive means coincident therewith and further comprising second reflector means disposed at the other side of said planar area in front of said machine tool and being inclined similarly to the inclination of said first reflector means in order to return radiant energy which traverses said planar area back to said first reflector means.

7. The apparatus of claim 1 wherein said machine tool has an internal hold-down means which is lowered towards said guide means surface in front of said work zone to clamp said work stock against said surface prior to contact of said tool element with said work stock, and wherein said manually operable auxiliary hold-down means is situated in front of said internal hold-down means and is operable independently of said internal hold-down means.

8. The apparatus of claim 1 wherein said manually operated auxiliary hold-down means comprises a clamping member disposed above said surface of said guide means in parallel relationship to said surface and in parallel relationship to said work zone, and support means attaching said clamping member to said machine tool for movement towards such guide means surface and away therefrom in response to movement of said actuating element.

9. The apparatus of claim 8 further comprising a releasable latch means coupled to said support means for selectively locking said clamping member at a selected vertical position.

10. The apparatus of claim 8 wherein said support means comprises a rod extending transversely across the front of said machine tool above said surface of said guide means and above said work zone and being supported on said machine tool by attachment means enabling rotational motion of said rod, means for translating rotational motion of said rod into vertical motion of said clamping member, and wherein said actuating element of said auxiliary hold-down means is at least one lever extending radially from said rod.

11. The apparatus of claim 10 wherein said lever is angularly oriented on said rod to extend downwardly therefrom when said clamping member is retracted from said surface and is pivoted upwardly to lower said clamping member.

12. The apparatus of claim 10 wherein said attachment means comprises at least a spaced-apart pair of housings secured to said machine tool above said surface of said guide means and being transpierced by said rod and wherein said motion-translating means comprises at least a pair of pinion gears each being secured coaxially to said rod within a separate one of said housings, at least a pair of linear toothed racks each extending vertically within a separate one of said housings and being engaged with said pinion gear therein for vertical movement in response to rotational motion of said pinion gears and at least a pair of links each extending downward to said clamping member from a separate one of said toothed racks.

13. The apparatus of claim 12 wherein said machine tool has an internal hold-down means which moves downwards towards said surface of said guide means in advance of movement of said tool element to said work stock, said internal hold-down means having a transverse shelf and a plurality of spaced-apart clamping elements extending downward from said shelf toward said surface, and wherein said clamping member of said auxiliary hold-down means is convoluted to extend around each of said clamping elements and into the region between each adjacent pair of said clamping elements, and wherein said links pass through apertures in said shelf to connect with said clamping member below said shelf.

14. The apparatus defined in claim 1 wherein said machine tool is a shear machine for cutting successive increments from flat sheet work stock situated on said surface of said guide means and wherein said tool element is a cutting blade movable toward said flat sheet work stock at an edge of said surface and wherein said work zone is a linear cutting zone at said edge of said surface.

* * * * *